US005293955A

United States Patent [19]

Lee

[11] Patent Number: 5,293,955

[45] Date of Patent: Mar. 15, 1994

[54] OBSTACLE SENSING APPARATUS FOR A SELF-PROPELLED CLEANING ROBOT

[75] Inventor: Jang W. Lee, Busan, Rep. of Korea

[73] Assignee: Goldstar Co., Ltd., Seoul, Rep. of Korea

[21] Appl. No.: 998,941

[22] Filed: Dec. 30, 1992

[30] Foreign Application Priority Data

Dec. 30, 1991 [KR] Rep. of Korea ..... 25531/1991

[51] Int. Cl.[5] ..... A47L 9/28

[52] U.S. Cl. ..... 180/169; 15/319; 318/587

[58] Field of Search ..... 15/319, 340.1; 901/1; 318/580, 587; 180/167, 169

[56] References Cited

FOREIGN PATENT DOCUMENTS 2-241420 9/1990 Japan .

*Primary Examiner*—Margaret A. Focarino
*Assistant Examiner*—Michael Mar
*Attorney, Agent, or Firm*—John P. White

[57] ABSTRACT

This invention relates to an obstacle sensing apparatus for a self-propelled cleaning robot which is capable of accurately sensing the position of an obstacle without the influence of ultrasonic directivity, and which comprises mounting members (22) disposed at both sides of the front portion of a body(11) of the robot; each made of a three-sided plate including a central portion facing forwardly of the body(11), one side portion bent at an angle of 90° relative to the central portion, and one side portion inclined at an angle of 45° relative to the central portion; ultrasonic distance-measuring means disposed in each portion of each mounting member(22) and an ultrasonic distance-measuring circuit (27) to which the ultrasonic elements are connected; and control means for judging presence and absence of an obstacle on the basis of the output of the ultrasonic distance-measuring means, thereby controlling the direction of travel of the body(11).

3 Claims, 8 Drawing Sheets

OBSTACLE SENSING APPARATUS FOR A SELF-PROPELLED CLEANING ROBOT

BACKGROUND OF THE INVENTION

1. Field of the Invention

This invention relates to an obstacle sensing apparatus for a self-propelled cleaning robot, and more particularly to an improved arrangement of ultrasonic elements, which minimize the influence of ultrasonic directivity during cleaning operations of the self-propelled cleaning robot, thereby precisely sensing a position of an obstacle.

2. Description of the Prior Art

Generally, a self-propelled cleaning robot is of the type as shown in FIGS. 1 to 3 of the accompanying drawings, which comprises a body 1, driving and steering means 2 for moving the body, combined driving and steering wheels 3, auxiliary wheels 4, a power source, i.e., a battery 5, travel direction determining means 6, mounting members 9 disposed at both sides of the front portion of the body 1 and each made of a three-sided plate having a forwardly facing central portion and right and left side portions inclined inwardly at an angle of 45° relative to the central portion, ultrasonic distance-measuring means including three ultrasonic elements *7a*, *7b*, *7c* disposed at each mounting member 9 and ultrasonic distance-measuring circuits 8, 8, 8 connected one to each of the ultrasonic elements, and obstacle discriminating means for judging presence and absence of an obstacle on the basis of the output of the ultrasonic distance-measuring means.

Operation of the self-propelled cleaning robot thus constructed will now be explained with reference to FIGS. 4 to 7.

First, when the gleaning robot travels in a juxtaposed manner along a left side wall 100 from position $P_1$ to position $P_s$ as shown in FIG. 4, the driving and steering means 2 is operated by the travel direction determining means 6 to control the posture of the body 1 in such a manner that if the ultrasonic element *7a* of the ultrasonic distance-measuring means facing the side wall 100 senses the side wall which gives obstacle information as shown in FIG. 5, the body is turned to the right, otherwise the body is turned to the left. In this manner, the robot travels along the side wall 100 in the direction of travel of $P_1$ to $P_s$, while maintaining a parallel relationship to the side wall in response to sensing of the side wall (i.e., the obstacle) by the ultrasonic element *7a*.

Then, when the robot has reached the position $P_s$, as shown in FIG. 6, and the ultrasonic element *7c* facing forwardly detects a new side wall 101 perpendicular to the left side wall 100, the robot first stops traveling, and the driving and steering wheels 3 are turned to the right by an angle of 90° by the travel direction determining means 6 to turn the body to a position in which the left side ultrasonic element *7c* cannot detect any side walls. Thus, the body 1 is positioned parallel to the new side wall 101, as shown in FIG. 6, and thus can again begin to travel along the new side wall. From this position, as shown in FIG. 4, the robot travels toward position $P_4$ while keeping a parallel relationship to the new side wall in the same manner as the travel from $P_1$ to $P_s$ as described above. Here, similar parts are denoted by similar numerals and actions of the respective constituent elements are not described further because the actions are the same as those in the travel from $P_1$ to $P_s$.

FIG. 7 is an explanatory view shoving sensing areas of the ultrasonic elements in operation of the ultrasonic distance-measuring means of the self-propelled cleaning robot according to the prior art. During traveling of the robot, when the ultrasonic distance-measuring means operates, the central ultrasonic element *7b* can detect an obstacle existing within the range of about$\pm L_l$ (about$\pm$15 cm) from the central axis of the element. Further, each of the ultrasonic elements *7a*, *7c* disposed at the inclined side portions of each mounting member 9 can detect an obstacle existing within the range of the interior distance of $L_l$ from the central axis of the element of the mounting member 9 and a perpendicular line $W_l$ or $W_s$ passing through the center of the right or left ultrasonic element *7a* or *7c*) from the central axis. Therefore, the ultrasonic distance-measuring means can detect the obstacle within the range of 90° which is the angle that the right side inclined portion of the mounting member 9 makes with the left side inclined portion of the member. Each of the ultrasonic elements *7a*, *7b*, *7c* used for the detection of the obstacle is of the horn type.

The prior art cleaning robot as described above is disclosed in Japanese Laid-Open Patent Publication HEI 2-24142 (the applicant: Matsushita Electric Company), the contents of which are incorporated herein by reference.

In the ultrasonic elements applied in the prior art cleaning robot as discussed above, the intensity of a sonic wave is highest in the forward direction, but becomes weaker in both lateral directions because of ultrasonic directivity. As used herein, the term "ultrasonic directivity" means that since an ultrasonic wave does not have a straight traveling property, its sensitivity varies depending upon direction, so that precise distance determination may not be accomplished.

More specifically, since an ultrasonic signal has greater amplitude at a short distance and less amplitude at a long distance, as shown in FIG. 8, when the ultrasonic wave is emitted, without being directed to an obstacle as indicated by arrow A (assuming that the obstacle is located in the distance beyond the sensing area of the ultrasonic element), the ultrasonic element *7c* is affected by the ultrasonic wave of greater amplitude from the ultrasonic element *7a* that is, from the ultrasonic directivity as indicated by arrow B. Accordingly, the cleaning robot may mistakenly determine the distance of the obstacle as being closer than the actual distance. As a result, during traveling, a malfunction of the robot or a breakdown of the robot due to a collision with the wall may take place.

SUMMARY OF THE INVENTION

With the foregoing problem of the prior art in view, it is an object of the present invention to provide an obstacle sensing apparatus for a self-propelled cleaning robot, which is capable of accurately sensing a position of an obstacle substantially without the influence of ultrasonic directivity through an improved arrangement of ultrasonic elements.

To achieve the above object, there is provided according to one form of the present invention an obstacle sensing apparatus for a self-propelled cleaning robot which automatically carries out cleaning of a floor surface while traveling on the surface, the apparatus comprising mounting members disposed at both sides of the front portion of a body of the robot and each made of a three-sided plate comprising a central portion facing forwardly of the body, one side portion bent at an angle of 90° relative to the central portion and the other side portion inclined at an angle of 45° relative to the central portion; ultrasonic distance-measuring means including first, second and third ultrasonic elements disposed one at each of the three side portions of each the mounting member and an ultrasonic distance-measuring circuit connected to the ultrasonic elements; and control means for judging presence and absence of an obstacle on the basis of the output of the ultrasonic distance-measuring means, thereby controlling the direction of travel of the body.

BRIEF DESCRIPTION OF THE DRAWINGS

In the accompanying drawings

DESCRIPTION OF THE PREFERRED EMBODIMENT

The invention will nowbe described in detail, by way of example, with reference to FIGS. 9 to 16 of the accompanying drawings.

Figure 1:
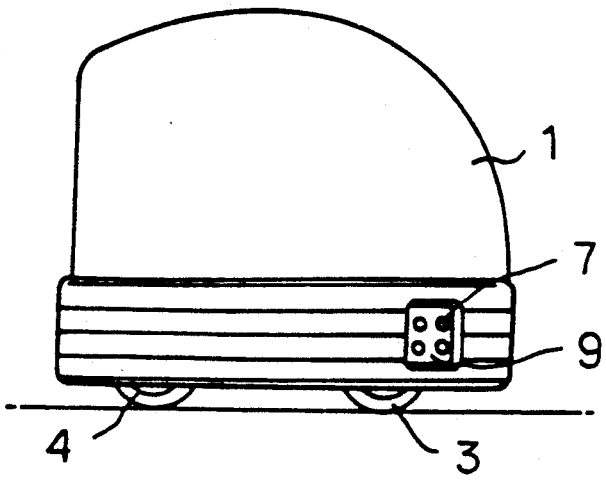
F I G. 1 PRIOR ART
FIG. 1 is a side view of a self-propelled cleaning robot provided with an obstacle sensing apparatus according to prior art
Figure 2:
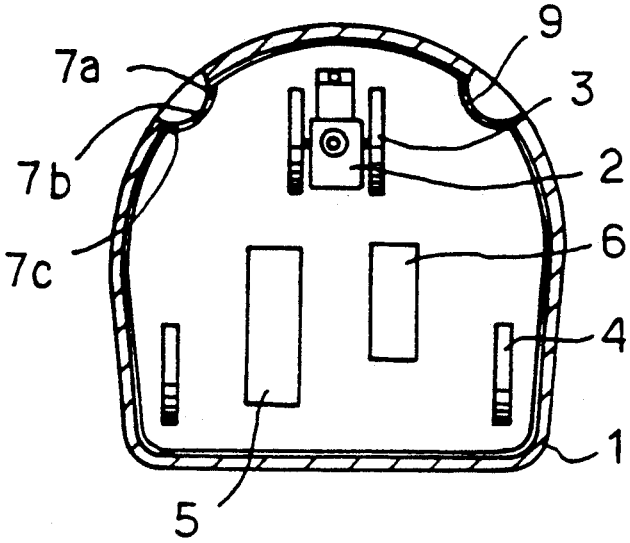
F I G. 2 PRIOR ART
FIG. 2 is a diagrammatic cross-sectional view showing the important parts of the prior art self-propelled cleaning robot.
Figure 3:
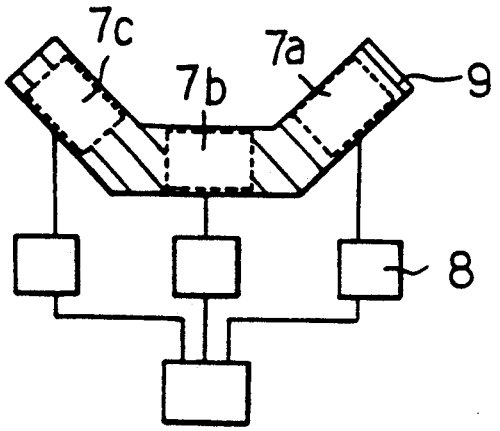
F I G. 3 PRIOR ART
FIG. 3 is a diagrammatic cross-sectional view showing the important parts of the prior art self-propelled cleaning robot.
Figure 4:
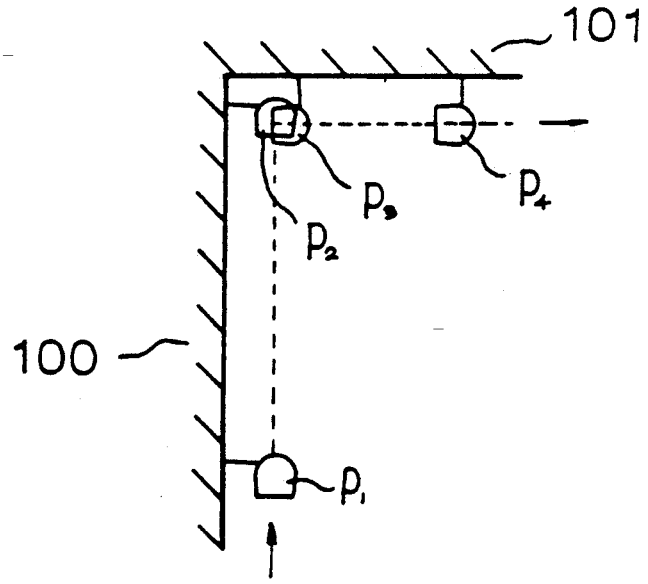
F I G. 4 PRIOR ART
FIG. 4 is a view for explaining the state in which the prior art cleaning robot travels from position $P_1$ to position $P_4$.
Figure 5:
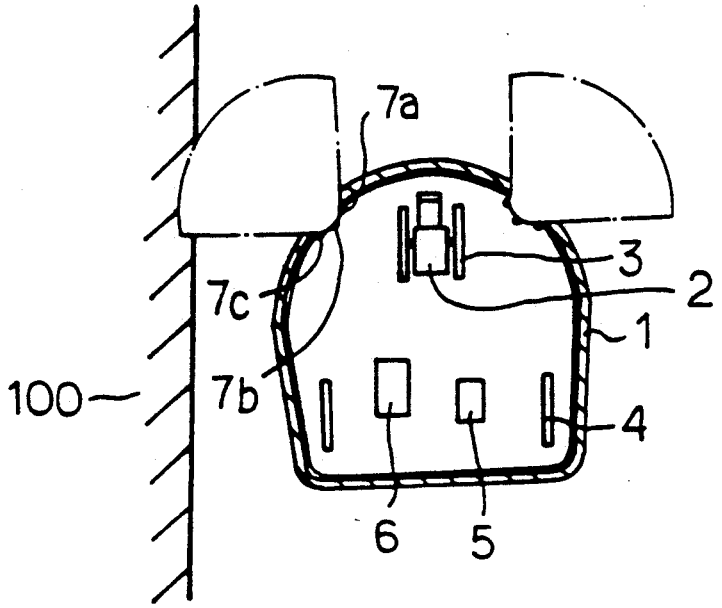
FIG. 5 PRIOR ART
FIG. 5 is a diagrammatic cross-sectional view shoving the prior art cleaning robot in the position $P_1$ of FIG. 4.
Figure 6:
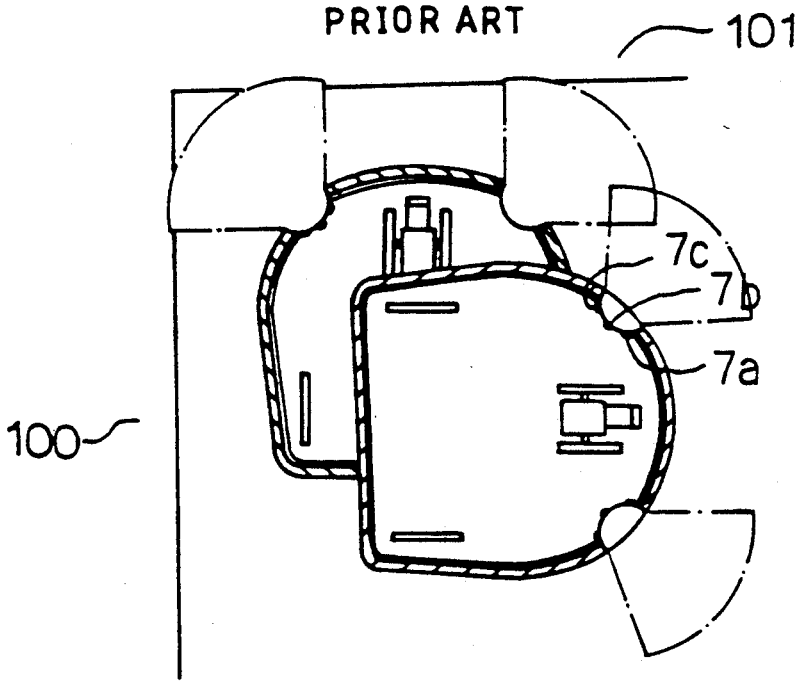
FIG. 6 PRIOR ART
FIG. 6 is a view shoving the state in which the prior art cleaning robot is turned from the position $P_s$ to the position $P_s$.
Figure 7:
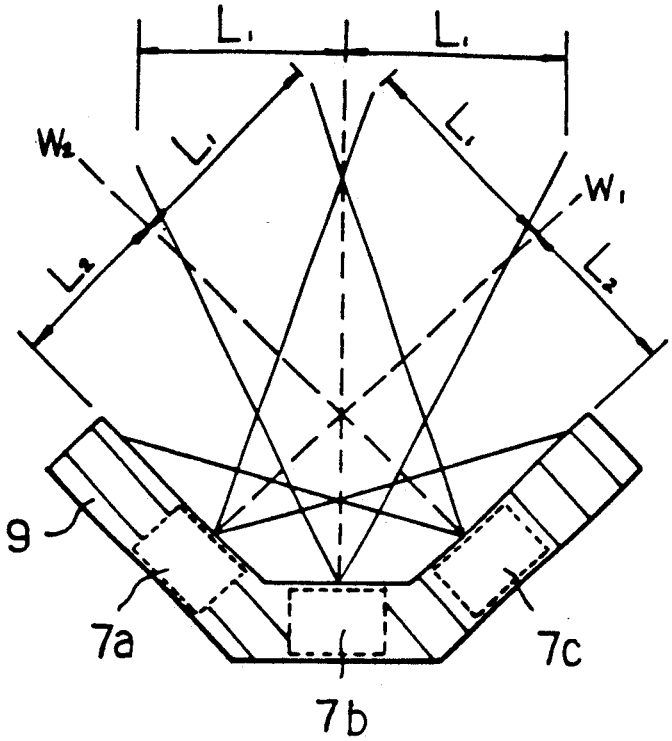
FIG. 7 PRIOR ART
FIG. 7 is an explanatory view showing sensing areas of ultrasonic elements in operation of the ultrasonic distance-measuring means of the prior art robot.
Figure 8:
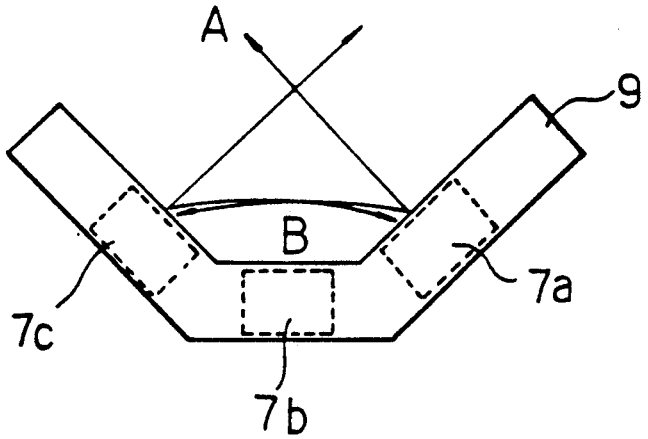
FIG. 8 PRIOR ART
FIG. 8 is a view for explaining a malfunction due to ultrasonic directivity in actual use of the prior art cleaning robot.
Figure 9:
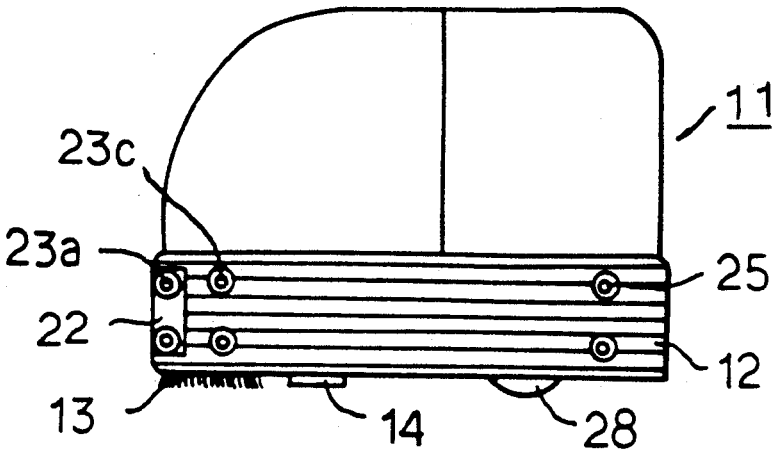
FIG. 9 is a side view of a self-propelled cleaning robot provided with an obstacle sensing apparatus according to the present invention
Figure 10:
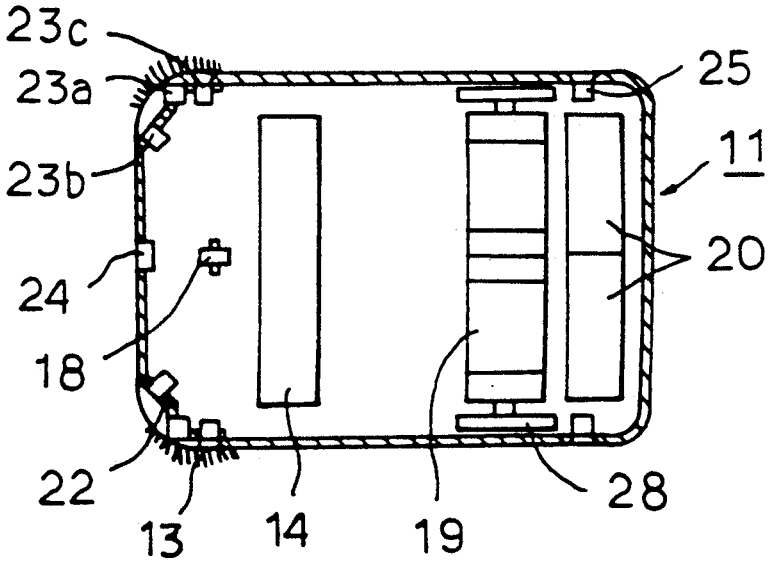
FIG. 10 is a transverse cross-sectional view of the cleaning robot, showing the important parts of the present invention
Figure 11:
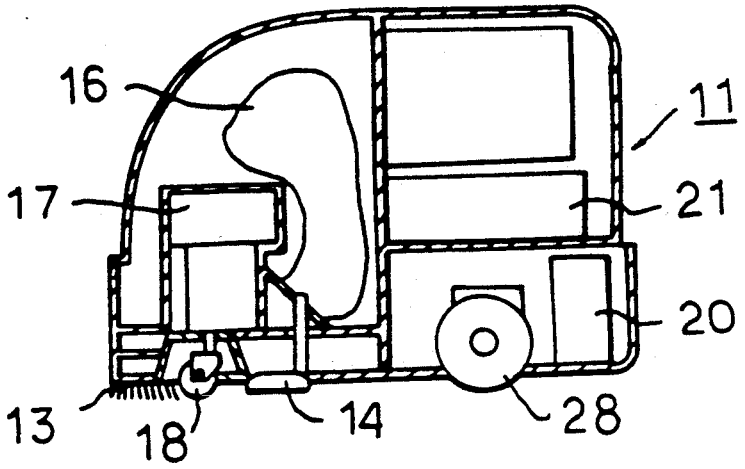
FIG. 11 is a longitudinal cross-sectional view of the cleaning robot of the present invention.

FIG. 9 shows a side view of a self-propelled cleaning robot provided with an obstacle sensing apparatus according to the present invention, and FIGS. 10 and 11 show transverse and longitudinal cross-sectional views of the cleaning robot of FIG. 9.

The cleaning robot according to the present invention comprises a body 11 having a bumper 12 of a soft rubber material which wraps around the outer periphery of the lower portion of the body, thereby absorbing a shock resulting from collision with a wall, and rotary brushes 13 mounted for rotation at the under sides of both front corner portions of the body to sweep off dust or dirt on a floor. In addition, rearward of the rotary brushes 13, a suction opening 14 of a rectangular shape is transversely provided at the under side of the body to be connected to a suction pack 16 contained in a dust collecting chamber.

Further, a suction motor 17 is disposed in the dust collecting chamber to drive a fan, thereby applying a vacuum for sucking in dust or dirt during cleaning operation, and a freely rotating auxiliary wheel 18 is mounted in the area between the rotary brushes 13 and the suction opening 14.

There are also disposed in the interior of the body 11 a circuit driving battery 20 for providing a power source necessary for a circuit section and wheel drive motors 19, and a suction motor driving battery 21 for providing a power source necessary for the suction motor 17. The construction of the robot as set forth above is substantially the same as that of the prior art, and thus the detailed description thereof is omitted herein.

According to a preferred embodiment of the present invention, the obstacle sensing apparatus comprises mounting members 22 disposed at both sides of the front portion of the body 11 and each made of a three-sided plate having a central portion facing forwardly of the body, one side portion integral with one end of the central portion and bent at an angle of 90° relative to the central portion to extend rearwardly of the body, and the other side portion integral with the other end of the central portion and inclined at an angle of 45° relative to the central portion to extend forwardly and inwardly of the body. Further, the apparatus comprises ultrasonic distance-measuring means including first, second and third ultrasonic elements 23*a*, 23*b*, 23*c* disposed one at each of the three side portions of each mounting member 22 and an ultrasonic distance-measuring circuit 26 connected to the ultrasonic elements.

In addition, as shown in FIG. 10, a fourth ultrasonic element 24 is disposed centrally of the front portion of the body 11 to detect an obstacle positioned ahead of the body, and fifth ultrasonic elements 25 are disposed one at each of the rear portions of the opposite side of the body so as to cooperate with the third ultrasonic element to maintain an equilibrium state of the body.

Figure 12:
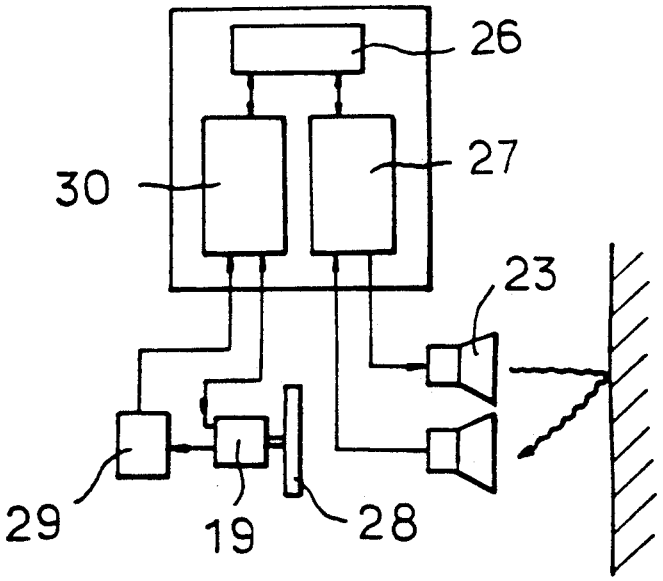
FIG. 12 is a circuit diagram of control means according to the present invention.

The apparatus of the present invention further comprises control means for judging presence and absence of an obstacle on the basis of the output of the ultrasonic distance-measuring means, thereby controlling the direction of travel of the body 11. As shown in FIG. 12, the control means comprises a decision section 26 for determining the travel distance and direction of the body on the basis of sensed information of the obstacle provided by the ultrasonic distance-measuring means, a driving circuit section 30 for driving the wheel drive motors 19 and hence drive wheels 28 in accordance with a command from the decision section 26, and a travel distance and direction sensing section 29 for perceiving rotation data of the drive wheels 28 driven by the driving circuit section 30. In this case, an encorder, a tachogenerator or the like may be used for the distance and direction sensing section 29.

Operation of the thus constructed apparatus of the present invention will now be explained.

Figure 13:
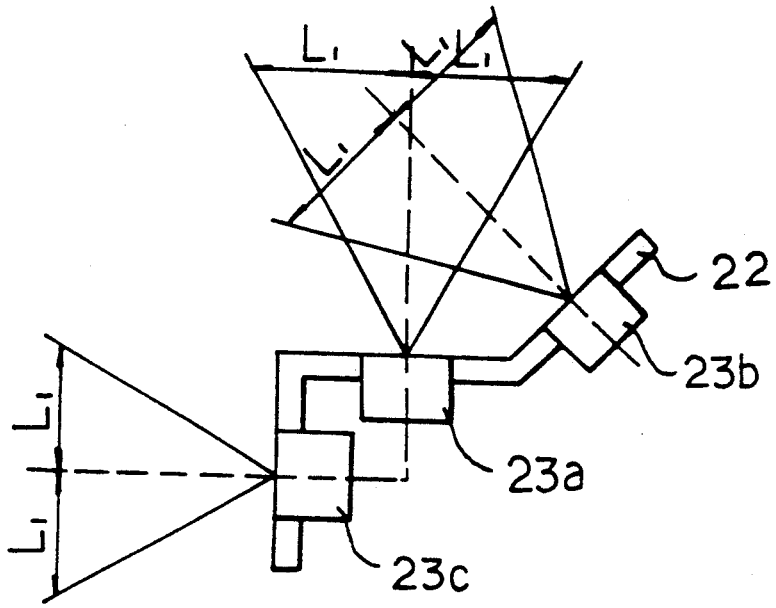
FIG. 13 is an explanatory view showing sensing areas of ultrasonic distance measuring means in operation of the obstacle sensing apparatus according to the present invention.

Referring to FIG. 13 which is a view for explaining sensing areas of the ultrasonic distance-measuring means in operation of the obstacle sensing apparatus according to the present invention, the first ultrasonic element 23*a* is mounted at the forwardly facing central portion of each mounting member 22 made of the three-sided plate, the second ultrasonic element 23*b* is mounted at the side portion inclined at an angle of 45° relative to the central portion to extend forwardly and inwardly of the body 11, and the third ultrasonic element 23*c* is mounted at the side portion bent at angle of 90° relative to the central portion. All of the first, second and third elements 23*a*, 23*b*, 23*c* can detect obstacles existing within the range of $\pm L_1$ from the central axis of each element. With the ultrasonic elements thus arranged, interference due to ultrasonic directivity does not occur at all and precise information about the obstacle can be obtained so that accurate control of travel of the robot can be carried out.

Figure 14:
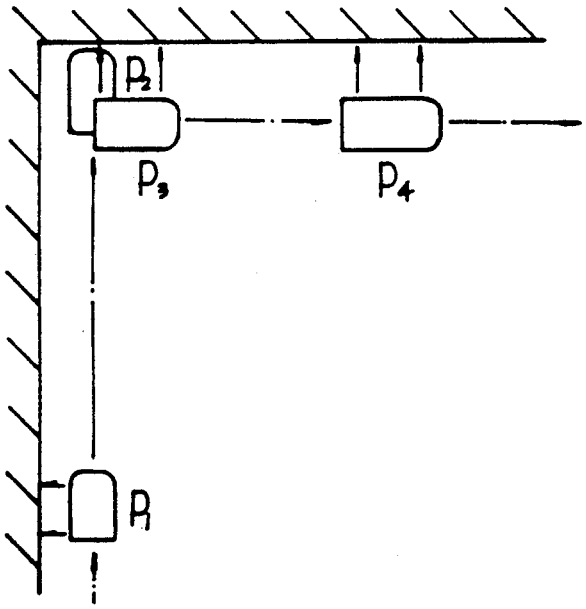
FIG. 14 is a view for explaining the state in which the cleaning robot of the present invention travels from position $P_1$ to position $P_4$.
Figure 15:
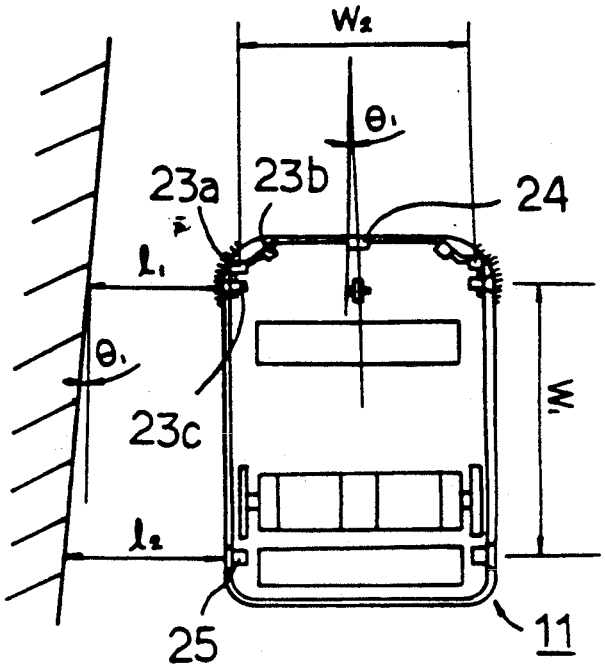
FIG. 15 is a diagrammatic cross-sectional view showing the cleaning robot of the present invention in the position $P_1$ of FIG. 14.

FIG. 14 is a view showing the state in which the cleaning robot of the present invention travels from position $P_1$ to position $P_4$, and FIG. 15 is a diagrammatic sectional view for explaining operation of the ultrasonic distance measuring means of the cleaning robot at position $P_1$. At the position $P_1$, as shown in FIG. 15, when measuring the distance between the wall and the robot by using the third and fifth ultrasonic elements 23*c*, 25, assuming that the distance between the wall and the third ultrasonic element 23*c* is $l_1$, the distance between the wall and the fifth ultrasonic element 25 is $l_2$, and the distance between the third and fifth elements is $W_1$, the angle of inclination of the body 11 relative to the wall, $\theta_1$, can be expressed by the following equation:

$$\theta_1 = \tan^{-1}\frac{l_3 - l_2}{W_1}$$

Figure 16:
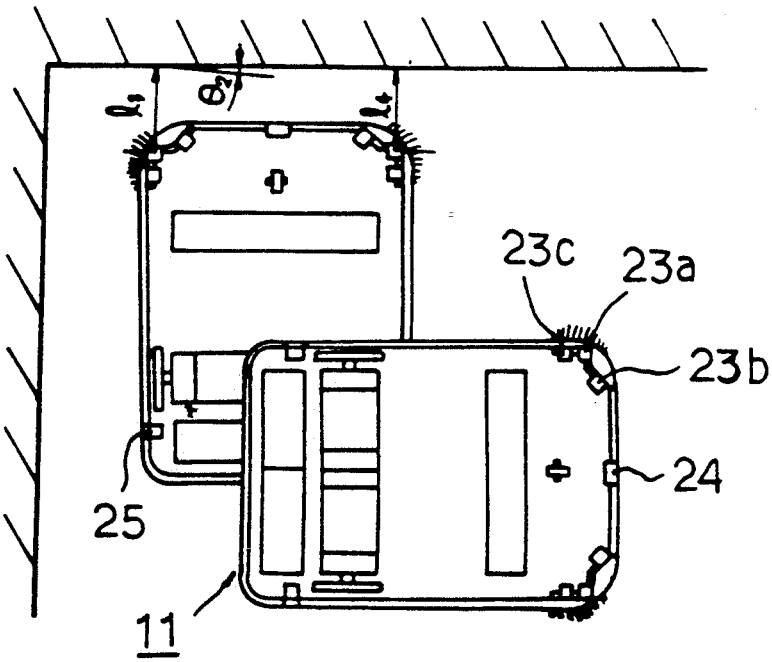
FIG. 16 is a view showing the state in which the cleaning robot of the present invention is turned from the position $P_s$ to the position $P_3$.

Therefore, when the body 11 is obliquely positioned at an angle of $\theta_1$ relative to the wall as viewed in plan, the decision section 26 of the control means orders the driving circuit section 30 to selectively drive the wheel drive motors 19, thereby positioning the body 11 in a parallel relationship to the wall. The robot thus adjusted in position to be parallel to the wall travels along the wall, and at the same time performs the cleaning operation. At this time, the ultrasonic elements 23*a*, 23*b*, 23*c* disposed at the mounting members 22 and the ultrasonic element 24 disposed centrally of the front portion of the body operate to detect an obstacle or a wall located ahead of the body. When any obstacle or wall is not present in front of the body, the robot continues to travel. Thereafter, as the robot reaches the position $P_s$, the first and fourth ultrasonic elements 23*a*, 24 detect a new wall and send signals to the ultrasonic distance-measuring circuit 27, which in turn sends a signal to the decision section 26 to stop the robot. At this time, when the stopped body 11 is positioned obliquely relative to the new wall located ahead of the body, as shown in FIG. 16, assuming that the distance between the wall and the first ultrasonic element of the left side mounting member is $l_3$, the distance between the wall and the first ultrasonic element of the right side mounting member is $l_4$, and the distance between the first ultrasonic elements of the left and right side mounting members is $W_s$, the angle of inclination, $\theta_s$, can be given by the following equation $$\theta_2 = \tan^{-1}\frac{l_4 - l_3}{W_2}$$

As a result, the body 11 is adjusted in position to be parallel to the new wall in response to orders from the decision section 26 in the same manner as described above.

Thereafter, the body is turned to the right through an angle of 90° by rotating the drive wheels 28 in the opposite directions in response to orders from the decision section 26 of the control means. At this time, the turned position of the body can be easily perceived by sensing a parallel state of the body relative to the wall by the third ultrasonic element 23*c* disposed at the left side mounting member 22 and the fifth ultrasonic element 25 disposed at the rear portion of the left side wall of the body.

Thus, when the body 11 is located at the position P, , and there is no obstacle or wall ahead of the forwardly facing ultrasonic elements 23*a*, 24, a parallel state of the body relative to the wall is checked by the sensing action as described above. As a result, when it has been confirmed that the body is in a parallel relationship to the wall, the robot travels to the position $P_4$, and at the same time performs the cleaning operation.

Although the foregoing has described the arrangement of the left side portion of the body for convenience sake, it will be understood that the construction and operation of the right side portion are identical with those of the left side portion. Therefore, they are not described further.

From the foregoing it will be appreciated that the present invention provides advantages over the prior art in that since the ultrasonic elements are disposed on the mounting member 22 of the three-sided plate configuration comprising a central portion facing forwardly of the body 11, one side portion bent at an angle of 90° relative to the central portion and the other side portion inclined at an angle of 45° relative to the central portion to extend forwardly and inwardly of the body, interference due to ultrasonic directivity may be prevented. Accordingly the robot can obtain precise information about the obstacle and travel without a malfunction. Furthermore, since the additional fourth ultrasonic element 24 is disposed centrally of the front portion of the body 11 to detect the obstacle positioned ahead of the traveling robot, the obstacle in front of the body can be promptly detected by the element so that travel of the robot can be controlled more precisely.

Furthermore, since a parallel state of the body 11 relative to the wall is checked by the third and fifth ultrasonic elements 23*c*, 25, and then the robot travels while always maintaining a parallel relationship to the wall, collision of the body 11 with the wall during traveling can be prevented.

While the invention has been shown and described with particular reference to a preferred embodiment thereof, it will be understood that variations and modifications in detail may be made therein without departing from the spirit and scope of the invention as defined in the appended claims.

What is claimed is:

1. An obstacle sensing apparatus for a self-propelled cleaning robot which automatically carries out cleaning of a floor space while traveling on the surface, the apparatus comprising:

a body having a front wall, opposite sidewalls, and a rear wall;

mounting members disposed at both sides of the front portion of the body at the intersection of the front wall and the sidewalls, each mounting member being made of a three-sided plate comprising a central portion extending transversely to a central longitudinal axis of said body, a first side portion bent at an angle of ninety degrees relative to the central portion, said first side portion extending rearwardly from said central portion and parallel to a respective sidewall, and a second side portion inclined at an angle of forty five degrees relative to the central portion and having an outer surface facing outwardly from the central longitudinal axis;

ultrasonic distance-measuring means including first, second and third ultrasonic elements disposed at respective ones of the three side portions of each said mounting member, each said ultrasonic element being mounted for directing ultrasonic waves in a direction extending perpendicular to a respective side portion, and an ultrasonic distance measuring circuit connected to the ultrasonic elements; and control means for judging presence and absence of an obstacle on the basis of the output of said ultrasonic distance-measuring means, thereby controlling the direction of travel of said body.

2. An obstacle sensing apparatus for a self-propelled cleaning robot as claimed in claim 1, in which said control means comprises a decision section for determining the travel distance and direction of said body on the basis of sensed information of the obstacle provided by said ultrasonic distance-measuring means; a driving circuit section for driving wheel drive motors and drive wheels in accordance with a command from said decision section; and a travel distance and direction sensing section for perceiving rotation data of said drive wheels driven by said driving circuit section.

3. An obstacle sensing apparatus for a self-propelled cleaning robot as claimed in claim 1, which further comprising a fourth ultrasonic element disposed centrally of said front wall of said body to detect the obstacle positioned ahead of said body; and fifth ultrasonic elements disposed one at each of the rear portions of the opposite sidewalls of said body so as to cooperate with said third ultrasonic element to maintain an equilibrium state of said body.

* * * * *